US007258376B2

(12) United States Patent
Webber

(10) Patent No.: US 7,258,376 B2
(45) Date of Patent: Aug. 21, 2007

(54) LIFTING AID FOR PLANAR MEMBERS

(76) Inventor: Cameron Webber, Box 1428, Elkford (CA) V0B 1H0

( * ) Notice: Subject to any disclaimer, the term of this patent is extended or adjusted under 35 U.S.C. 154(b) by 0 days.

(21) Appl. No.: 11/308,423

(22) Filed: Mar. 23, 2006

(65) Prior Publication Data

US 2006/0220402 A1 Oct. 5, 2006

Related U.S. Application Data

(60) Provisional application No. 60/594,371, filed on Apr. 1, 2005.

(51) Int. Cl.
*B66C 1/48* (2006.01)

(52) U.S. Cl. ..... 294/67.22; 294/103.1

(58) Field of Classification Search ..... 294/67.1, 294/67.2, 67.22, 67.3, 67.33, 103.1, 119.1, 294/164, 901
See application file for complete search history.

(56) References Cited

U.S. PATENT DOCUMENTS 3,749,437 A * 7/1973 Lynn ..... 294/81.5
3,851,358 A * 12/1974 Janosko ..... 294/104
5,071,183 A * 12/1991 McDermott et al. ..... 294/67.2
5,893,595 A * 4/1999 Corbett ..... 294/102.1
6,089,633 A * 7/2000 Jacob ..... 294/67.22
6,241,227 B1 * 6/2001 Berdan et al. ..... 269/17

* cited by examiner

*Primary Examiner*—Dean J Kramer
(74) *Attorney, Agent, or Firm*—Sean W. Goodwin; Linda M. Thompson

(57) ABSTRACT

A lifting aid for lifting and supporting a ground engagement tool has an L-shaped cradle having a longitudinally extending base and back wall. A lifting yoke having at least two tubular arms is slideably connected to the L-shaped cradle through tubular sleeves which extend upward to a lifting point. The tubular arms have an upper portion, and a lower portion angled relative to the upper portion, for forming an inflection point inclined rearward toward the back wall. In a rest position, the inflection point is positioned adjacent the tubular sleeves leaving space for the tool. In a lifted position, the inflection point approaches the back wall for gripping the tool therebetween.

10 Claims, 13 Drawing Sheets

LIFTING AID FOR PLANAR MEMBERS

CROSS REFERENCE TO RELATED APPLICATIONS

This application is a regular application claiming priority of U.S. Provisional Patent application Ser. No. 60/594,371 filed on Apr. 1, 2005, the entirety of which is incorporated herein by reference.

FIELD OF THE INVENTION

Embodiments of the present invention relate to accessories for use with heavy equipment such as bulldozers and graders and the like and, more particularly, to accessories which aid in replacement of cutting edges and wear plates or ground engagement tools (GETs) on said bulldozers, graders and the like.

BACKGROUND OF THE INVENTION

Heavy equipment used for grading, mining and the like is typically fit with a blade which has at least one replacement plate for improving a cutting or grading action of the blade and/or preventing wear of said blade. Often a blade may be fit with both a cutting edge and a wear plate fastened to the blade. Such plates are often referred to as ground engagement tools or GET.

As wear occurs, the GET is removed and replaced or rotated for use on an opposing side. Typically, a GET may be 8-12 inches high and at least 8 feet long and often weigh from about 500-600 pounds. During replacement, the GET must be lifted to align holes in the GET with holes on the blade and held in position while the GET is secured, such as by bolts, to the blade. Due to the weight and the relatively sharp lower edge of the GET, lifting and supporting the GET is difficult. The difficulty is further enhanced by the fact that the blade is typically at an angle and the center of gravity of the GET is shifted when positioned adjacent to the blade.

It is known to provide means for aiding in lifting and supporting a GET for attachment to a blade.

U.S. Pat. No. 5,071,183 to Mc Dermott et al. describes an elongate bar having brackets at each end of the bar in which a GET may be supported for mounting to the blade. The bracket provides a fixed width slot in which the GET is fit and supported against a back of the bracket. A suspension member is connected at a center of the bar and is angled for maintaining the GET at the desired angle when suspended from a crane or the like.

U.S. Pat. No. 6,241,227 to Berdan et al. describes a cart configured to support a GET at an angle suitable for attachment to a plow or grader blade. The frame and GET holder are moveable up and down relative to the ground for lifting the GET into pace adjacent the blade. The GET or GET and wear plate are supported against the back of L-shaped cradles which are a fixed on the frame at the desired angle. A nut and bolt assembly aids in retaining the GET in an upright positioned supported against the wall of the cradle.

Clearly what is required is a lifting aid which is relatively inexpensive to build and to operate and which can make use of existing on-site equipment, if possible, to assist in lifting and supporting a GET for removal and replacement. Of special importance is that the lifting aid safely and securely support the GET to prevent injury to workers during the process.

SUMMARY OF THE INVENTION

A unique lifting aid assists in lifting planar members which are typically heavy and awkward and further safely positions and holds the planar member at an angle suitable for connection of the planar member to a structure allowing an operator to connect the planar member in a safe and efficient manner.

In use, the lifting aid is particularly useful for lifting ground engagement tools for connection to the blade of plow or grader or other such equipment.

In a broad aspect of embodiments of the invention, a lifting aid for lifting and supporting a longitudinally extending planar member, such as a ground engagement tool for a blade, comprises: an L-shaped cradle having a longitudinally extending base and back wall; at least two substantially parallel tubular sleeves spaced apart at a front edge of the base, a top end of each of the at least two sleeves inclined rearward towards the back wall; and a lifting yoke having at least two tubular arms slideably connected to the L-shaped cradle through the tubular sleeves, the tubular arms extending upwardly and connected to a lifting point, the tubular arms having an upper portion and a lower portion angled relative to the upper portion for forming an inflection point extending rearward toward the back wall, wherein in a rest position, the inflection point is positioned adjacent the tubular sleeves for permitting the planar member to be positioned between the inflection point and the back wall, and in a lifted position, the inflection point approaches the back wall for gripping the planar member therebetween.

Preferably, the angle formed between upper and lower portions of each of the at least two tubular arms is sufficient to position a center of gravity of the lifting aid and the ground engagement tool engaged therewith substantially at an angle at which the ground engagement tool is adapted to be attached to an equipment blade.

In an embodiment of the lifting aid, indexing means are provided for connecting the tubular sleeves to the base for permitting adjustment of a distance between the point of inflection and the back wall which permits accommodating planar members of different thicknesses.

Preferably the indexing means comprises: at least two attachment plates, each attachment plate having a plurality of holes formed therein at spaced intervals, the at least two attachment plates being connected to an underside of the base adjacent the at least two tubular sleeves; and a flange connected to each of the at least two tubular sleeves for releasably engaging the plurality of holes in each of the at least two attachment plates for adjusting the positioning of the point of inflection relative to the back wall.

DETAILED DESCRIPTION OF THE PREFERRED EMBODIMENT

Figure 1A:
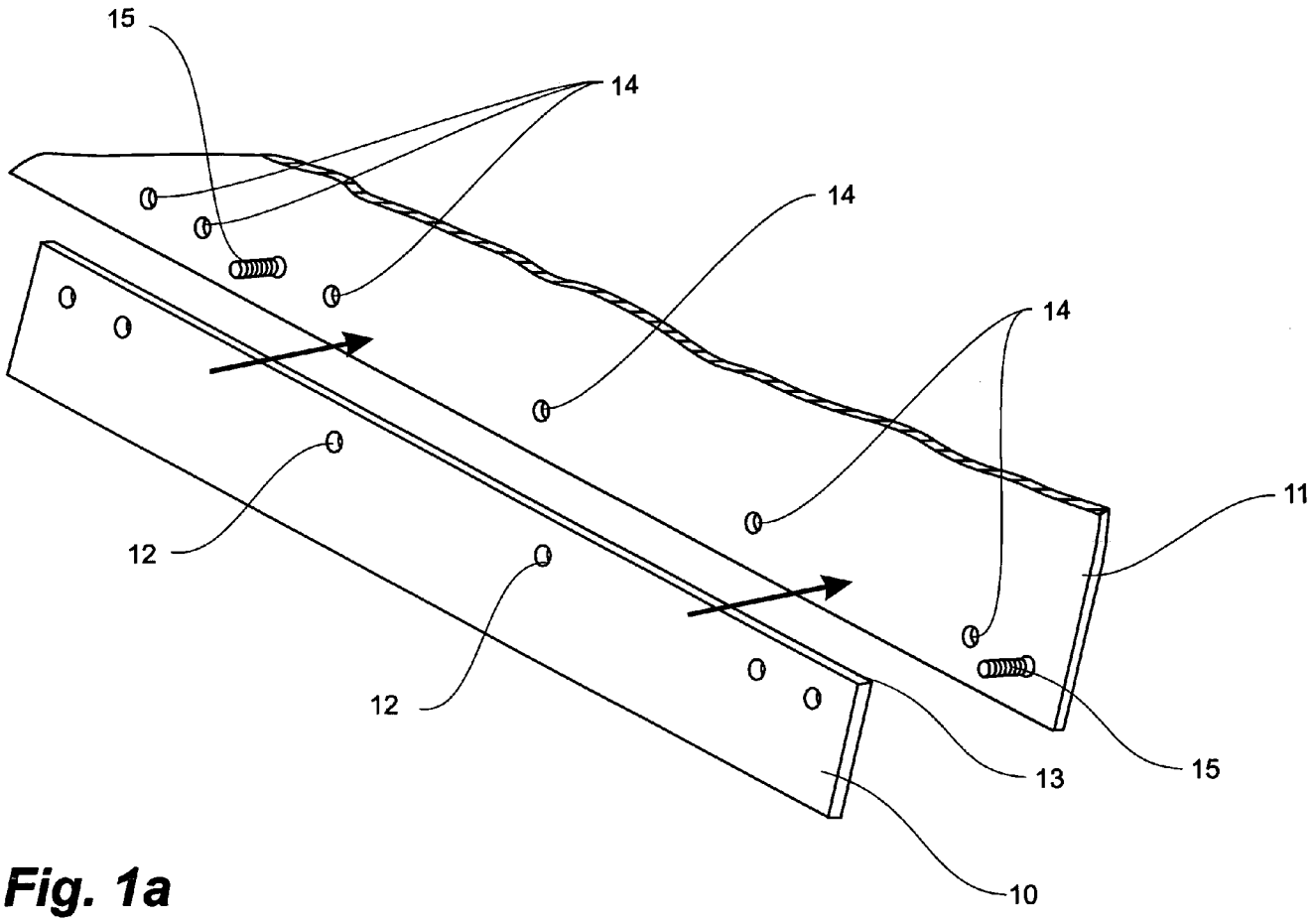
FIG. 1*a* is an exploded view of a ground engagement tool (GET) and a blade prior to assembly.

Having reference to FIG. 1*a*, a cutting edge, wear plate or the like, commonly referred to as a ground engagement tool or GET 10, is shown spaced apart from and in alignment with a blade 11 of a piece of equipment, such as a dozer or grader (not shown) to which the GET 10 is to be fastened. A plurality of holes 12 are formed in a top edge 13 of the GET 10 and co-operate with a plurality of holes 14 formed in the blade 11 for fastening the GET 10 to the blade 11, typically using fasteners 15, such as bolts.

Figure 2A:
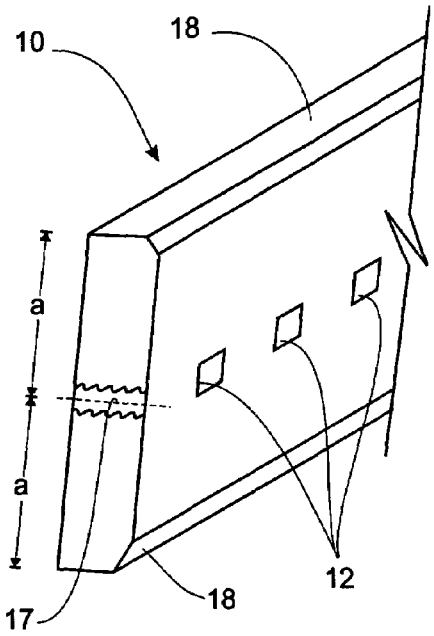
FIGS. 2*a*, 2*b* and 2*c* are perspective, side and side views of a reversible get for a blade such as a dozer blade.
Figure 2B:
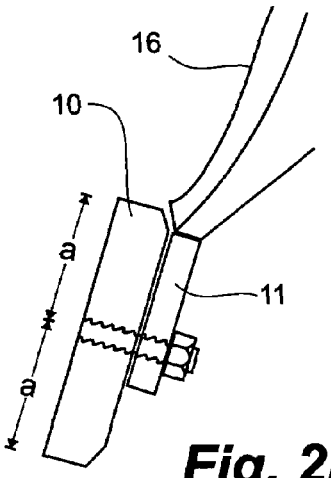
Figure 2C:
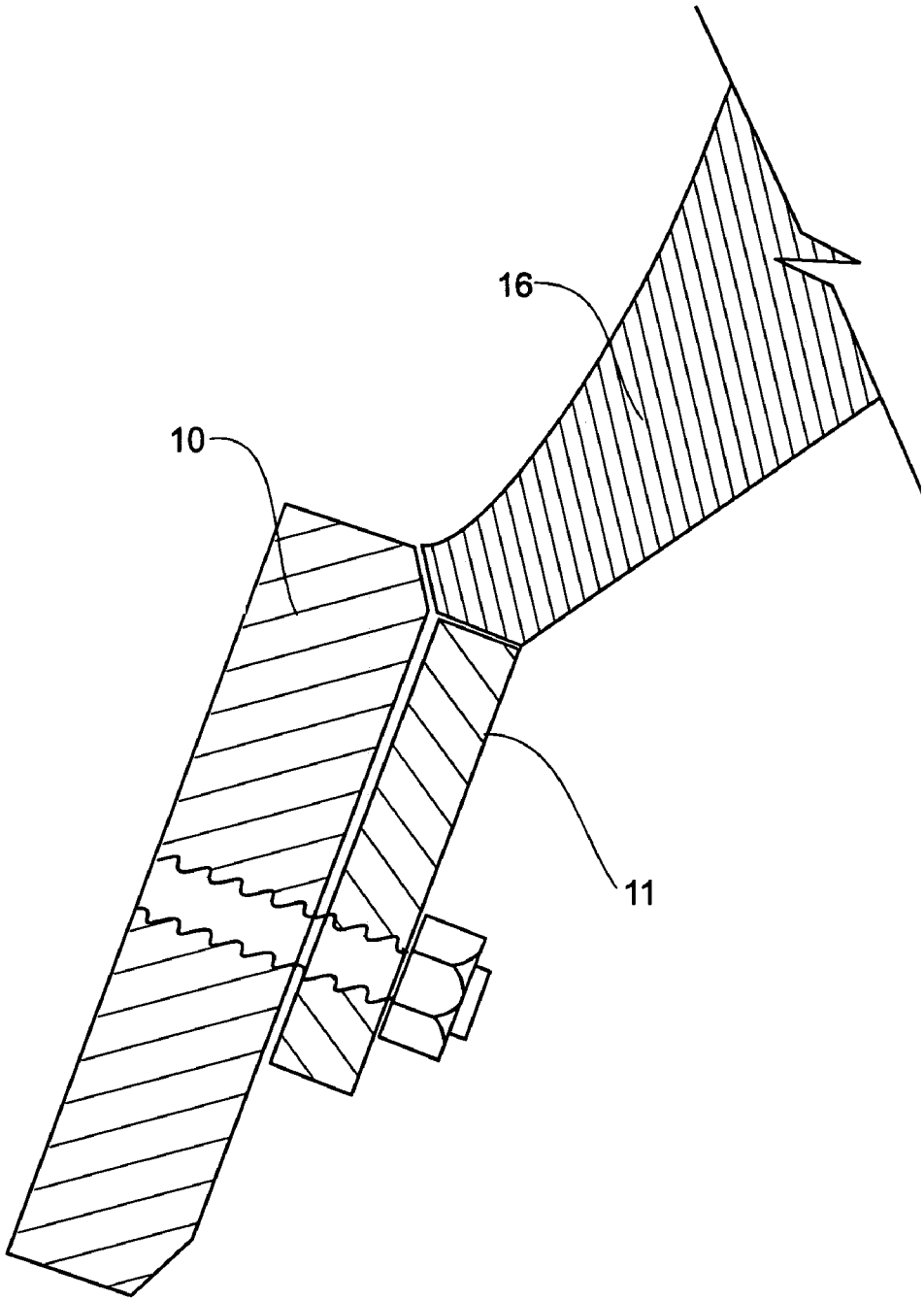

As shown in FIGS. 2*a*, 2*b* and 2*c* and in the case of a conventional GET 10 for a track dozer 16 (FIG. 2*b*), the holes 14 are formed at a center 17 of the GET 10 and the GET 10 is formed having reversible edges 18. Less than ½ a height of the GET 10 extends below the blade 11 when fastened thereto.

Figure 3A:
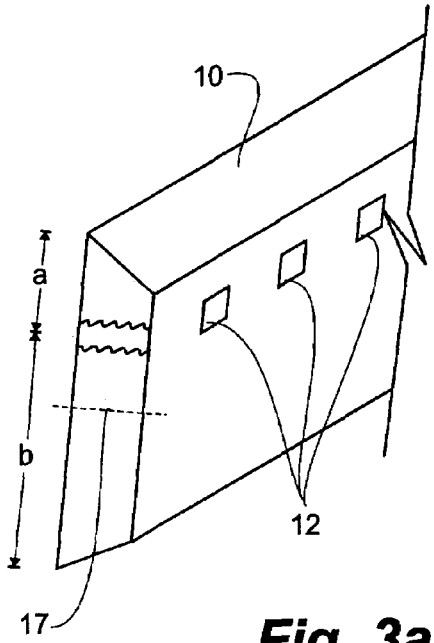
FIGS. 3*a* and 3*b* are perspective and side views of a non-reversible get for a blade such as a grader blade.
Figure 3B:
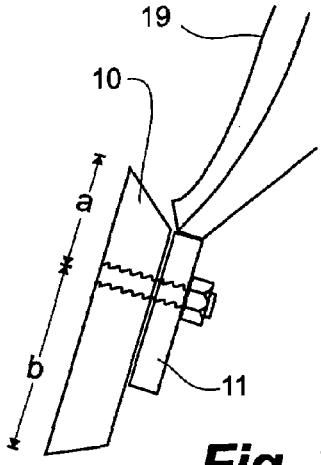

As shown in FIGS. 3*a* and 3*b*, and in the case of a conventional GET 10 for a grader 19 (FIG. 3*b*), the holes 14 are formed offset from the center 17 of the GET 10 and the GET 10 is not reversible. More than ½ the height of the GET 10 extends below the blade 11 when fastened thereto.

Having reference to FIGS. 4-8, and in an embodiment of the invention, a lifting aid 20 for supporting a longitudinally extending planar member, such as a GET 10, particularly during lifting and installation onto the blade 11 of a dozer or grader 16, 19, is shown. The lifting aid 20 comprises a longitudinally extending L-shaped cradle 21 having a base 22 and a back wall 23. At least two substantially parallel tubular sleeves 24 are spaced apart and affixed to a front edge 25 of the base 22. The sleeves 24 are inclined inward or rearward toward the back wall 23 at a top end 26. A lifting member or yoke 27 is connected to the L-shaped cradle 21 through the tubular sleeves 24.

As shown in FIGS. 6*b*, 6*c*, 7 and 8 and in one embodiment of the invention, the lifting yoke 27 comprises a pair of tubular arms 28 and a span member 29 connected therebetween at a top end 30 of each of the tubular arms 28. Further, a lifting point 31, such as a hole for engaging a hook extending from a crane boom (not shown), is formed at a center of the span member 29. The lifting point 31 is aligned with a center of the cradle 21 for supporting the GET 10 from lateral movement once engaged in the cradle 21.

In an alternate embodiment, as shown in FIGS. 9-13, the tubular arms 28 of the lifting yoke 27 extend upwards and towards each other for forming an inverted V-shaped lifting yoke. The lifting point 31 is formed at an intersection 32 at the top end 30 of the tubular arms 28 and is typically a loop 33 welded thereto for engaging the crane hook (not shown).

As shown in FIGS. 4, 5, 11 and 12 the tubular arms 28 of the lifting yoke 27 slideably extend through the tubular sleeves 24 for connecting the lifting yoke 27 thereto. The sleeves 24 are of sufficient length to prevent binding of the tubular arms 28 therein. A stop 34 is formed at a lower end 35 of each of the tubular arms 28 for preventing the arms 28 from leaving the tubular sleeves 24 once engaged therein.

The tubular arms 28 further comprise a lower portion 36 and an upper portion 37 which are angled relative to one another forming a point of inflection 38 therebetween.

Figure 4:
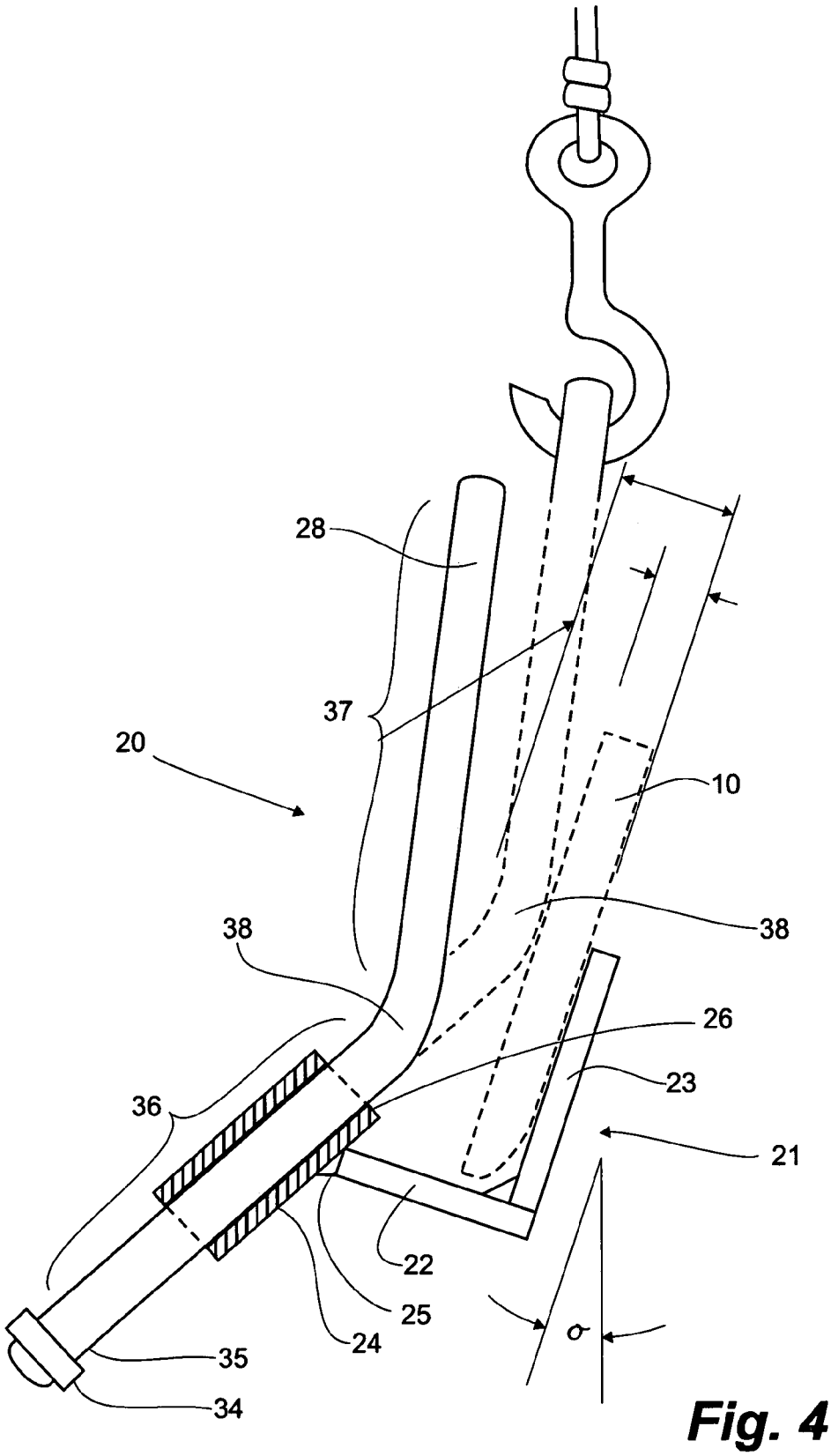
FIG. 4 is a side or end view of one embodiment of the invention in a rest position with dotted lines illustrating the lifted position.
Figure 11:
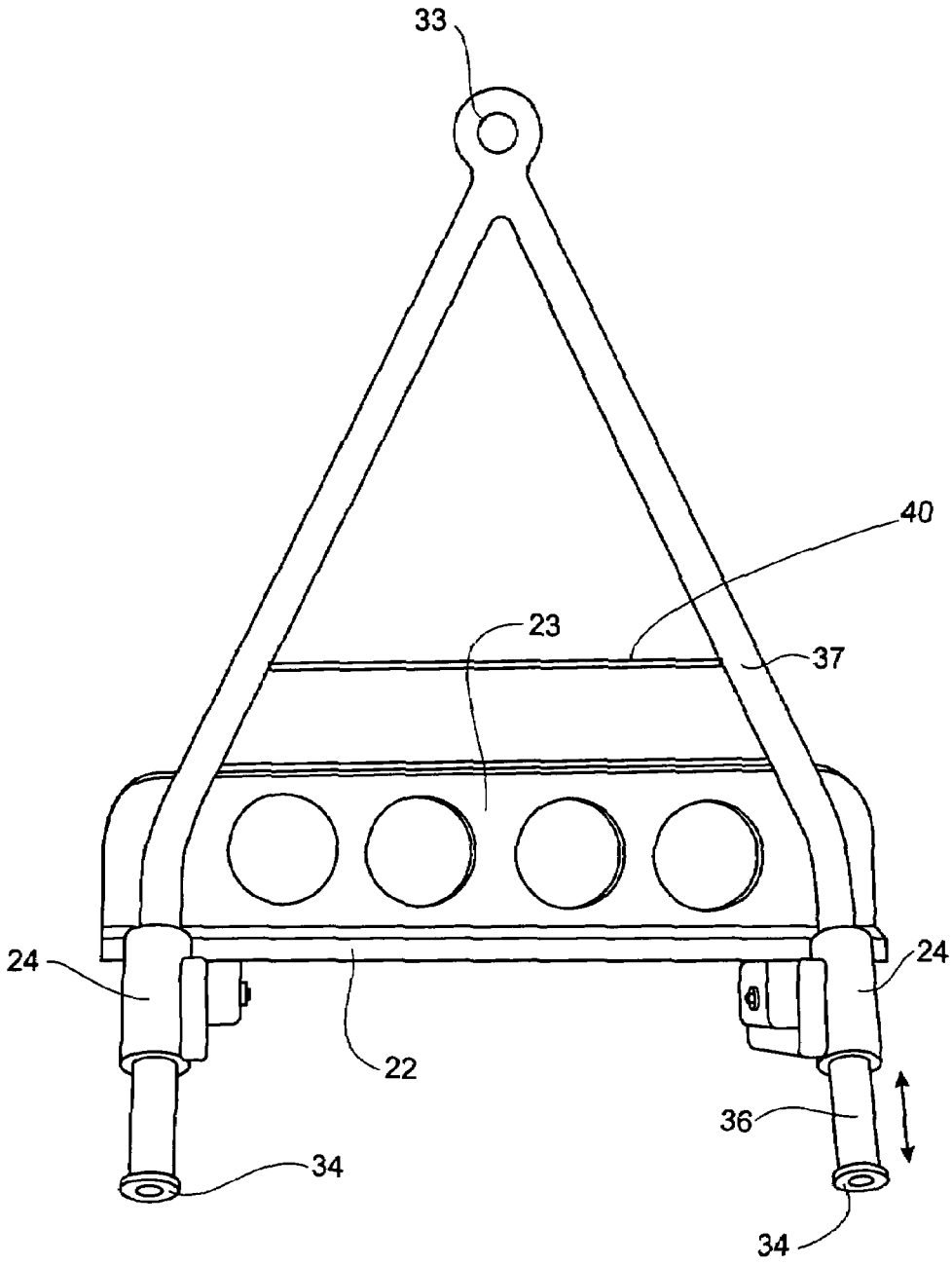
FIG. 11 is a front view of the embodiment of FIG. 9 illustrating the embodiment in the rest position.

As shown in FIGS. 4 and 11, in a rest position, the tubular arms 28 are positioned having the lower portion 36 engaged in the tubular sleeves 24 with the point of inflection 38 adjacent the sleeves 24 and spaced away from the back wall 23 of the cradle 21 to permit the GET 10 to be positioned between the tubular arms 28 and the back wall 23.

Figure 5:
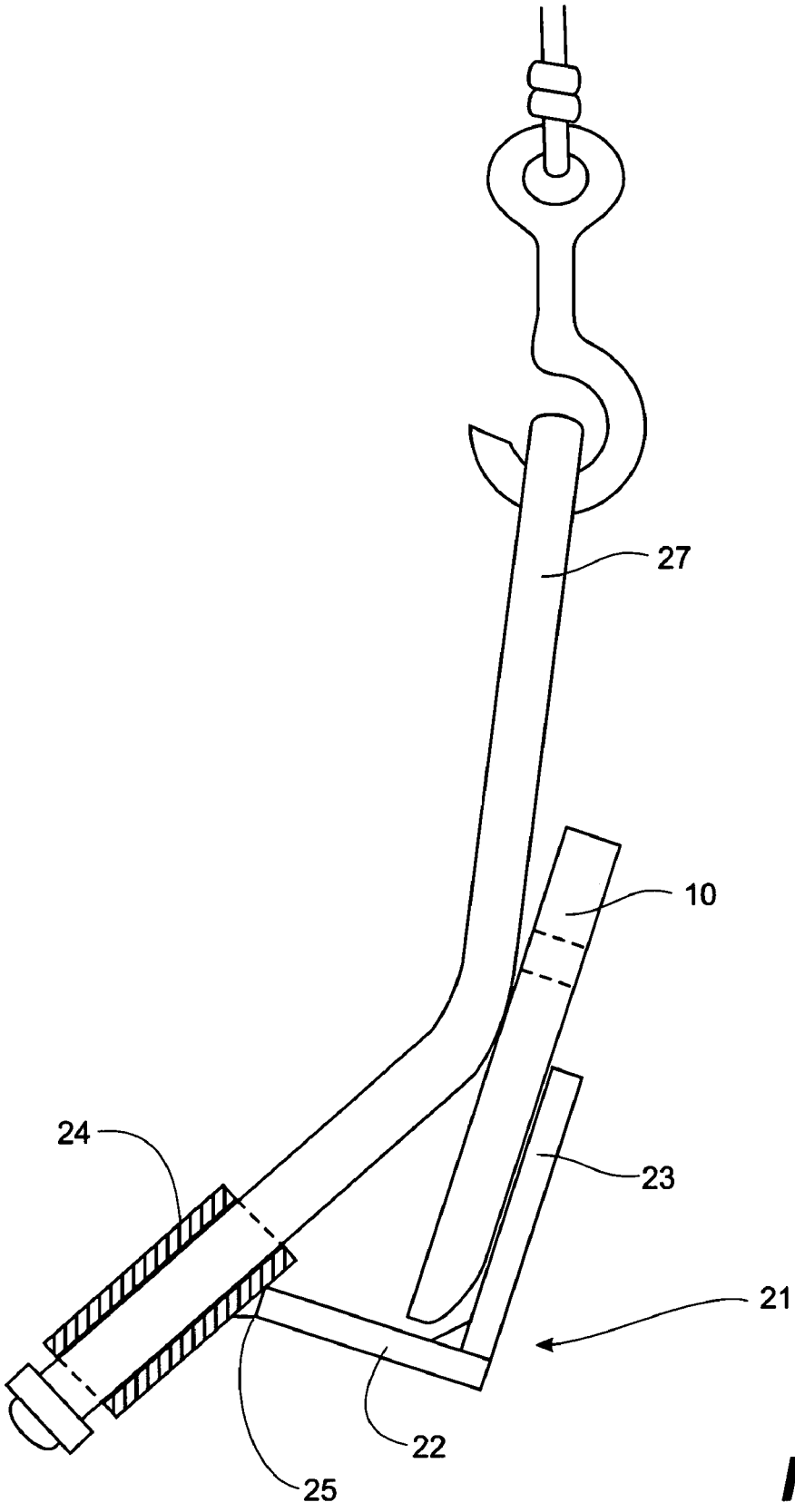
FIG. 5 is a side view of the embodiment of FIG. 4 in the lifted position with a GET pinched or gripped therein.
Figure 6A:
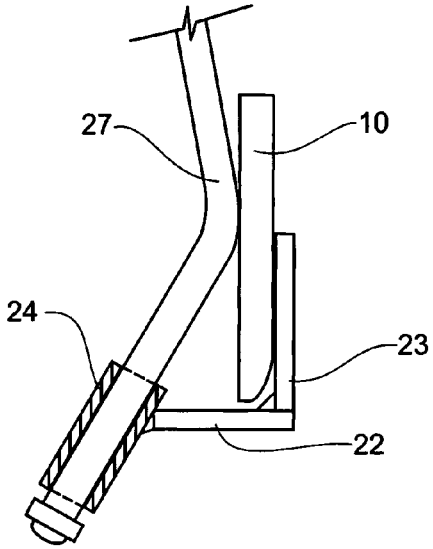
FIGS. 6*a*-6*c* are a side view, a front view and a front view with a GET according to one embodiment of the invention.
Figure 6B:
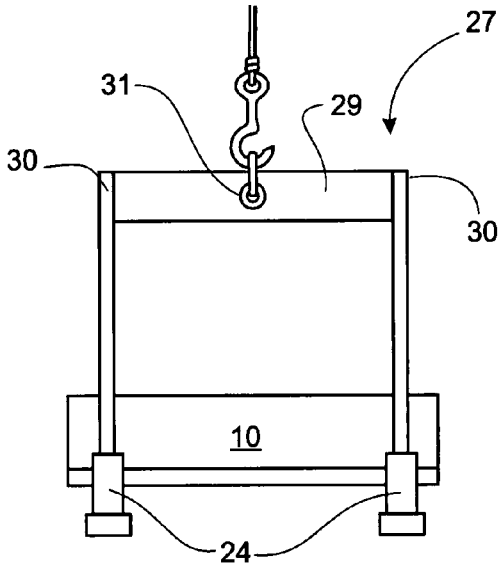
Figure 6C:
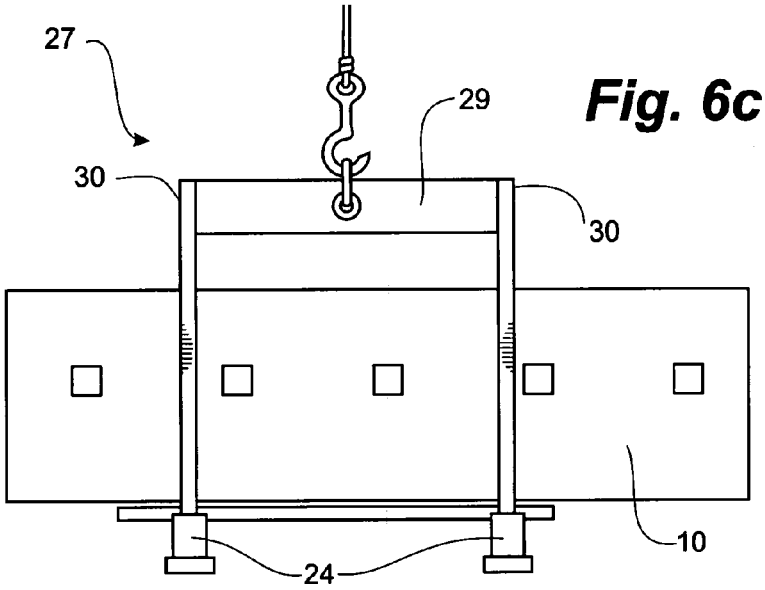
Figure 7:
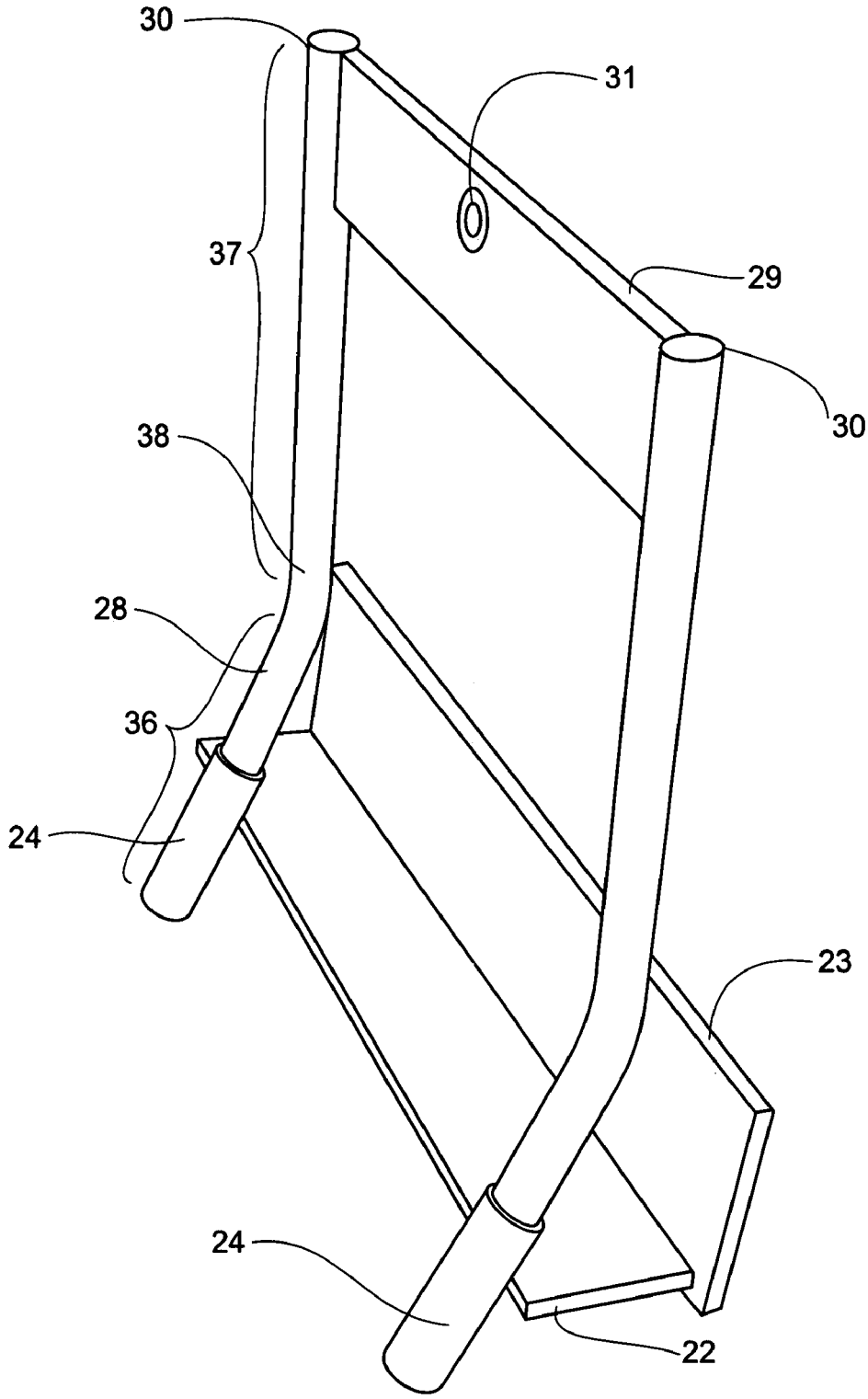
FIG. 7 is a perspective side view of the embodiment of FIGS. 6*b* and 6*c;*
Figure 8:
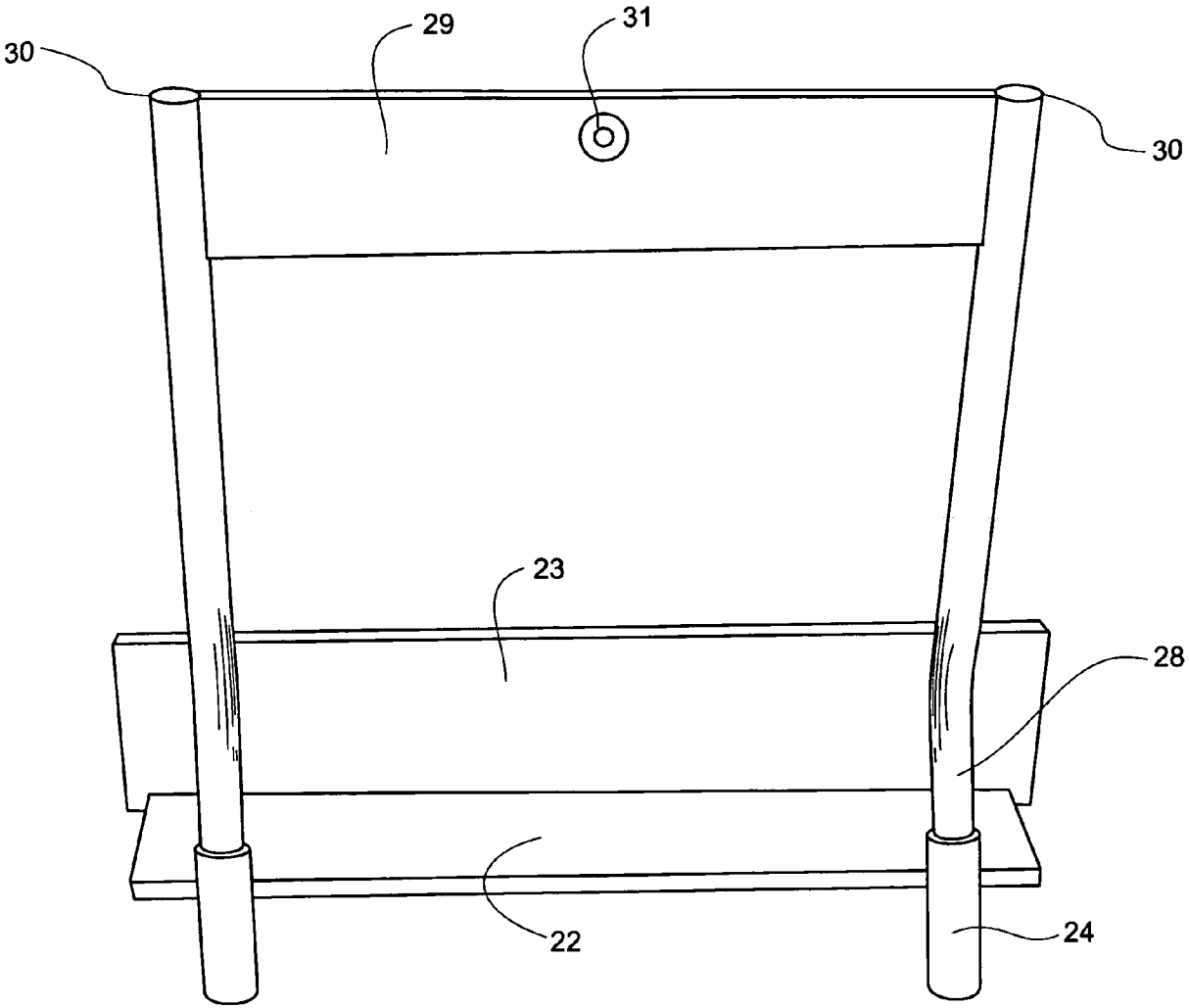
FIG. 8 is a perspective front view of the embodiment of FIG. 7.
Figure 9:
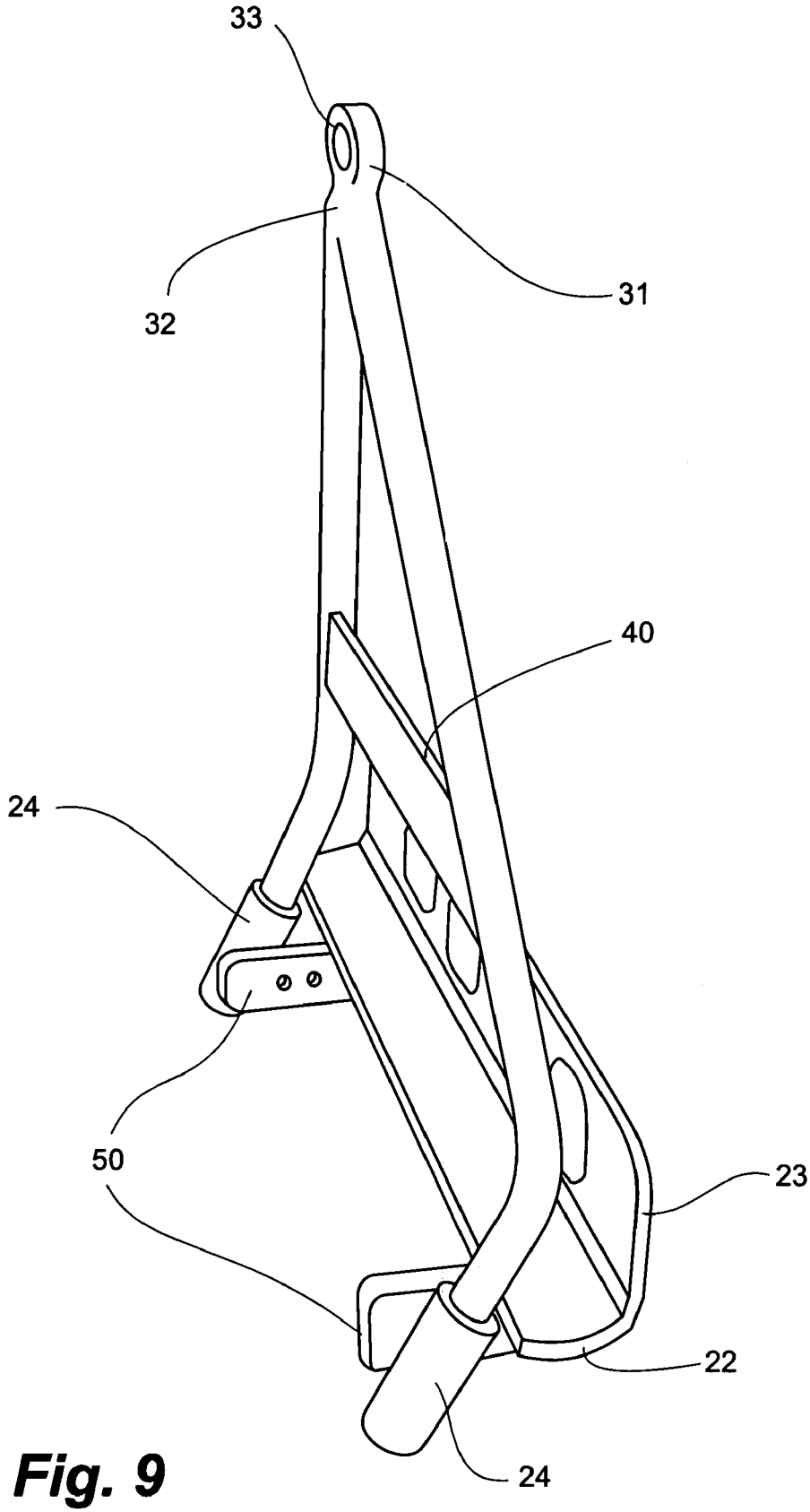
FIG. 9 is a side view of another embodiment having an inverted V shaped yoke.
Figure 10:
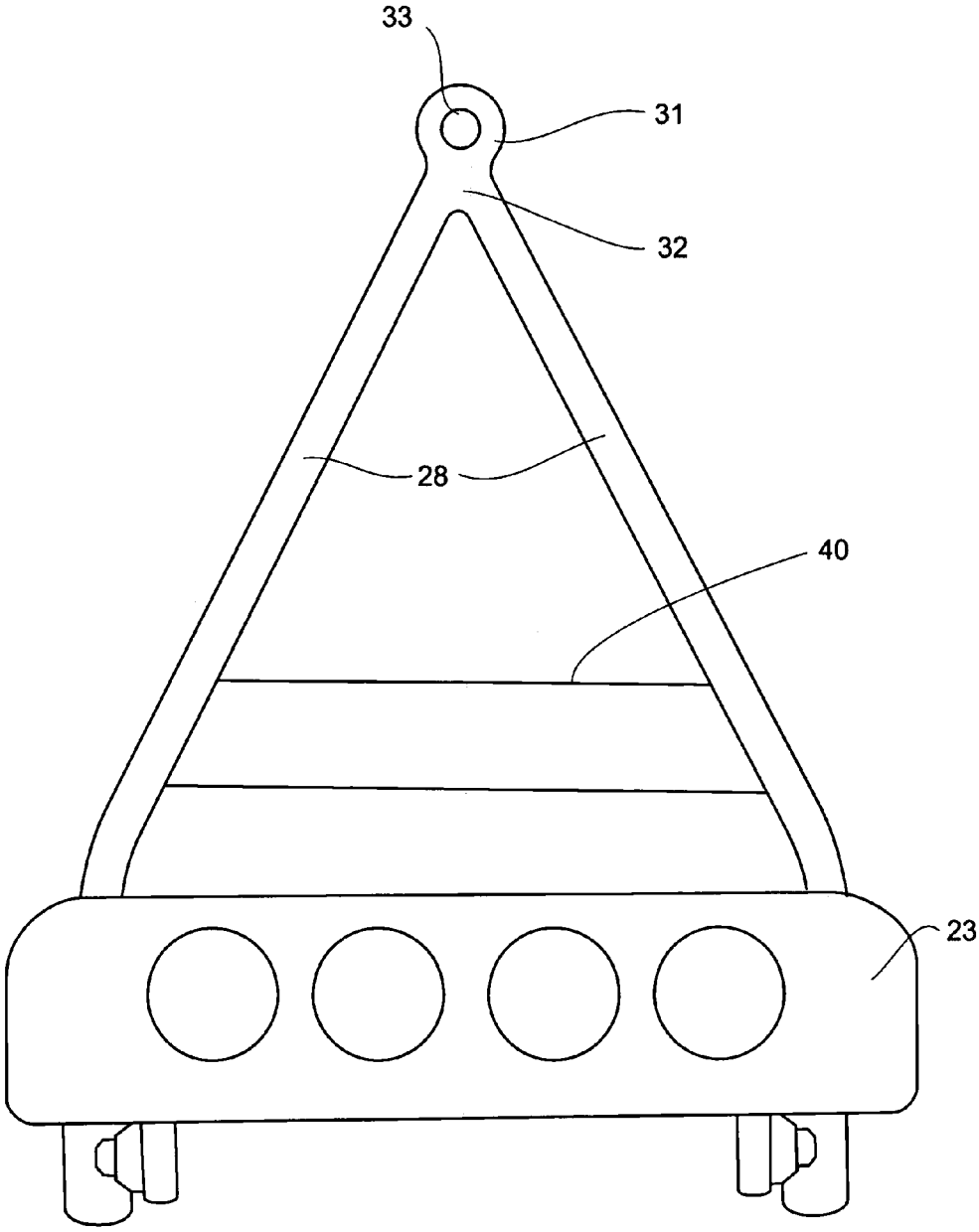
FIG. 10 is a back view of the embodiment of FIG. 9.
Figure 12:
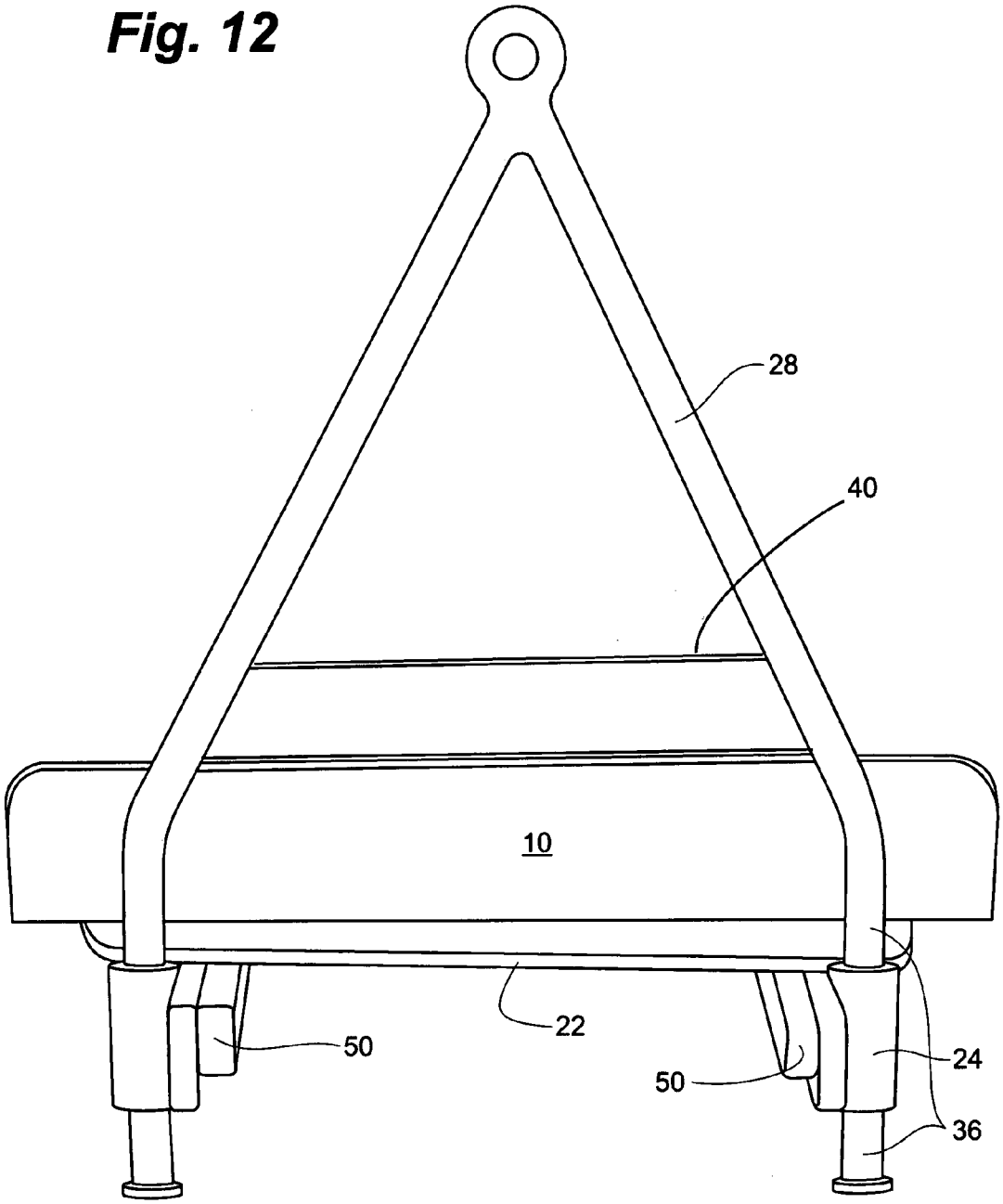
FIG. 12 is a front view of the embodiment of FIG. 9 illustrating the embodiment in the lifted position.

As shown in FIGS. 5 and 12, as the lifting yoke 27 is lifted, such as by a crane, the tubular arms 28 slide to move axially within the tubular sleeves 24 to a second gripping position wherein the point of inflection 38 is lifted and approaches the back wall 23 for pinching or gripping the GET 10 therebetween, Thus, as the lifting yoke 27 is actuated to lift the lifting aid 20 and the GET 10, the tubular arms 28 act to grip the GET 10 in the cradle 21 and more securely retain the GET 10 therein.

Further, and preferably, the angle formed between the upper and lower portions 36, 37 of the tubular arms 28 is sufficient to position the center of gravity of the lifting aid 20 and the GET 10 supported therein at an angle substantially the same as the angle of the blade 11 to which the GET is to be attached. As a result, less manipulation of the GET 10 and the lifting aid 20 is required for an operator to successfully secure the GET 10 to the blade 11 resulting in a safer operation.

Optionally, in the alternate embodiment, a transverse support member 40 may be connected between the tubular arms 28, spanning therebetween to increase the structural rigidity and to further support the lifting yoke 27.

Figure 13:
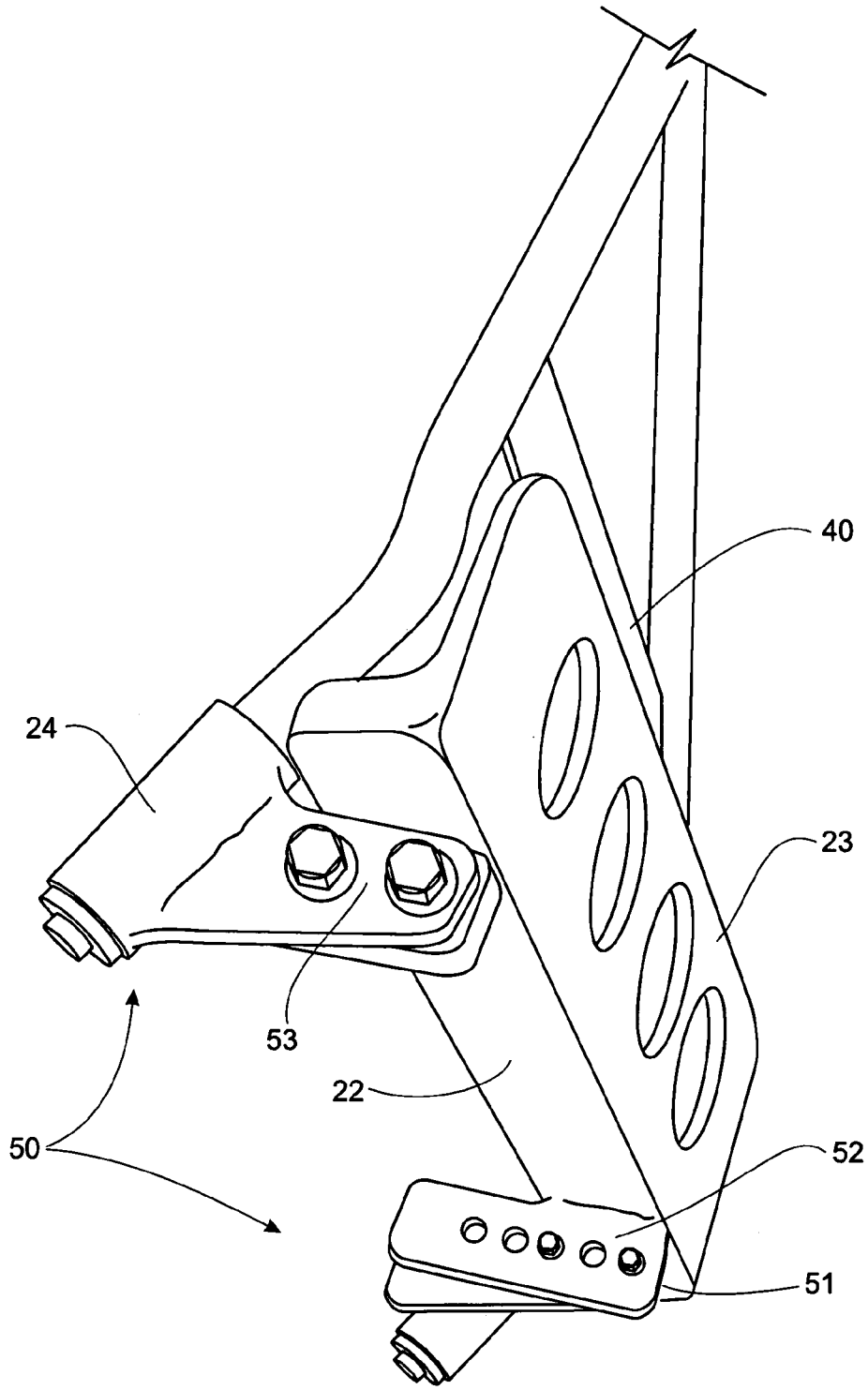
FIG. 13 is a side tilted view of an embodiment illustrating an indexing means connected to a bottom of the L-shaped cradle for removeably positioning the tubular sleeves relative to the base of the cradle.

Having reference to FIG. 13 and in an embodiment of the invention, the tubular sleeves 24 are connected to the base 22 of the cradle 21 through indexing means 50 which permit a distance D, between the point of inflection 38 of the tubular arms 28 and the back wall 23, to be changed to accommodate GET's having different thicknesses.

In one embodiment, the indexing means 50 comprises attachment plates 51 connected to an underside 52 of the base 22, adjacent each of the tubular sleeves 24, for removeably attaching the tubular sleeves 24 to the base 22. Each of the tubular sleeves 24 has a flange 53 connected thereto for connecting to the attachment plates 51. The attachment plates 51 have a plurality of holes 53 formed therethrough at spaced intervals therealong for adjusting the positioning of the sleeves relative to the base 22 and thus, the distance of the inflection point 38 from the back wall 23.

Optionally, material can be removed from the back wall 23, such as by holes 41 cut from the back wall 23, to reduce the weight of the lifting aid 20.

What is claimed is:

1. A lifting aid for lifting and supporting a longitudinally extending planar member comprising:

an L-shaped cradle having a longitudinally extending base and back wall;

at least two substantially parallel tubular sleeves spaced apart at a front edge of the base, a top end of each of the at least two sleeves inclined rearward towards the back wall; and a lifting yoke having at least two tubular arms slideably connected to the L-shaped cradle through the tubular sleeves, the tubular arms extending upwardly and connected to a lifting point, the tubular arms having an upper portion and a lower portion angled relative to the upper portion for forming an inflection point extending rearward toward the back wall, wherein in a rest position, the inflection point is positioned adjacent the tubular sleeves for permitting the planar member to be positioned between the inflection point and the back wall, and in a lifted position, the inflection point approaches the back wall for gripping the planar member therebetween.

2. The lifting aid of claim 1 wherein the planar member is a ground engagement tool.

3. The lifting aid of claim 2 wherein the angle formed between the upper and lower portions of each of the at least two tubular arms is sufficient to position a center of gravity of the lifting aid and the ground engagement tool engaged therewith substantially at an angle at which the ground engagement tool is adapted to be attached to an equipment blade.

4. The lifting aid of claim 1 further comprising indexing means for connecting the at least two tubular sleeves to the base for permitting adjustment of a distance between the point of inflection and the back wall for accommodating planar members of different thicknesses.

5. The lifting aid of claim 4 wherein the indexing means further comprises:

at least two attachment plates, each attachment plate having a plurality of holes formed therein at spaced intervals, the at least two attachment plates being connected to an underside of the base adjacent the at least two tubular sleeves; and a flange connected to each of the at least two tubular sleeves for releasably engaging the plurality of holes in each of the at least two attachment plates for adjusting the positioning of the point of inflection relative to the back wall.

6. The lifting aid of claim 1 wherein the lifting yoke further comprises a span member connected between the at least two tubular arms, the lifting point being formed in the span member.

7. The lifting aid of claim 6 wherein the lifting point is a hole formed substantially at a center of the span member adapted for engaging a hook of a crane.

8. The lifting aid of claim 1 wherein the at least two substantially parallel tubular sleeves are of sufficient length to prevent binding of the at least two tubular arms therein.

9. The lifting aid of claim 1 further comprising:

a stop formed at a lower end of each of the at least two tubular arms for retaining the at least two tubular arms in the at least two substantially parallel tubular sleeves.

10. The lifting aid of claim 1 further comprising:

a transverse member spanning between the at least two tubular arms for providing structural rigidity thereto.

* * * * *